US009082545B2

(12) United States Patent
Sugita et al.

(10) Patent No.: US 9,082,545 B2
(45) Date of Patent: Jul. 14, 2015

(54) ANTENNA DEVICE AND COMMUNICATION DEVICE

(75) Inventors: Satoru Sugita, Tochigi (JP); Toshiaki Yokota, Miyagi (JP); Yoshimi Takahashi, Miyagi (JP); Katsuhisa Orihara, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 226 days.

(21) Appl. No.: 13/807,068

(22) PCT Filed: Nov. 16, 2011

(86) PCT No.: PCT/JP2011/076455

§ 371 (c)(1),
(2), (4) Date: Feb. 22, 2013

(87) PCT Pub. No.: WO2012/073704

PCT Pub. Date: Jun. 7, 2012

(65) Prior Publication Data

US 2013/0169398 A1 Jul. 4, 2013

(30) Foreign Application Priority Data

Dec. 1, 2010 (JP) ..... 2010-268395

(51) Int. Cl.
*H01Q 7/08* (2006.01)
*H01F 38/14* (2006.01)
(Continued)

(52) U.S. Cl.
CPC ..... *H01F 38/14* (2013.01); *H01Q 1/002* (2013.01); *H01Q 1/2225* (2013.01); *H01Q 1/243* (2013.01); *H01Q 7/00* (2013.01)

(58) Field of Classification Search
CPC ..... H01Q 7/00; H01F 38/14
USPC ..... 343/741, 742, 787, 788, 866, 867, 749
See application file for complete search history.

(56) References Cited

U.S. PATENT DOCUMENTS 2,882,527 A * 4/1959 Morris ..... 343/788
3,049,711 A * 8/1962 Hooper ..... 343/702
(Continued)

FOREIGN PATENT DOCUMENTS

JP A-10-284315 10/1998
JP A-2007-104092 4/2007
(Continued)

OTHER PUBLICATIONS

International Search Report issued in International Patent Application No. PCT/JP2011/076455 dated Jan. 17, 2012.

*Primary Examiner* — Tho G Phan
(74) *Attorney, Agent, or Firm* — Oliff PLC

(57) ABSTRACT

An antenna device, capable of stable communications without increasing a space of the entire device by keeping a resonance frequency substantially constant even if the temperature changes, includes: an antenna circuit having an antenna coil with an electrically connected capacitor; the coil receiving a magnetic field transmitted from a reader/writer at a predetermined oscillation frequency; the circuit becoming communicable when inductively coupled to the reader/writer; and a magnetic sheet formed at a position superposed on the coil to change its inductance, wherein the coil has a temperature characteristic in which the inductance is changed with a temperature change, and the sheet has a temperature characteristic of changing the inductance to achieve a characteristic inverse to the inductance change with the temperature change in a predetermined use temperature range, and substantially matching a resonance frequency of the circuit with the oscillation frequency in the use temperature region.

4 Claims, 9 Drawing Sheets

(51) Int. Cl.

| | |
|---|---|
| ***H01Q 1/24*** | (2006.01) |
| ***H01Q 7/00*** | (2006.01) |
| ***H01Q 1/00*** | (2006.01) |
| ***H01Q 1/22*** | (2006.01) |

(56) References Cited

U.S. PATENT DOCUMENTS

| | | | | |
|---|---|---|---|---|
| 3,267,478 | A * | 8/1966 | Schiefer | 343/788 |
| 3,495,264 | A * | 2/1970 | Spears | 343/788 |
| 5,916,476 | A | 6/1999 | Shimazaki et al. | |
| 2005/0030243 | A1 * | 2/2005 | Ohara et al. | 343/788 |
| 2009/0146898 | A1 * | 6/2009 | Akiho et al. | 343/787 |
| 2010/0103055 | A1 | 4/2010 | Waku et al. | |
| 2010/0309081 | A1 * | 12/2010 | Kobayashi et al. | 343/788 |
| 2012/0206307 | A1 * | 8/2012 | Orihara et al. | 343/722 |

FOREIGN PATENT DOCUMENTS

| | | |
|---|---|---|
| JP | A-2007-304910 | 11/2007 |
| WO | WO 2008/105477 A1 | 9/2008 |
| WO | WO 2011/013662 A1 | 2/2011 |

* cited by examiner

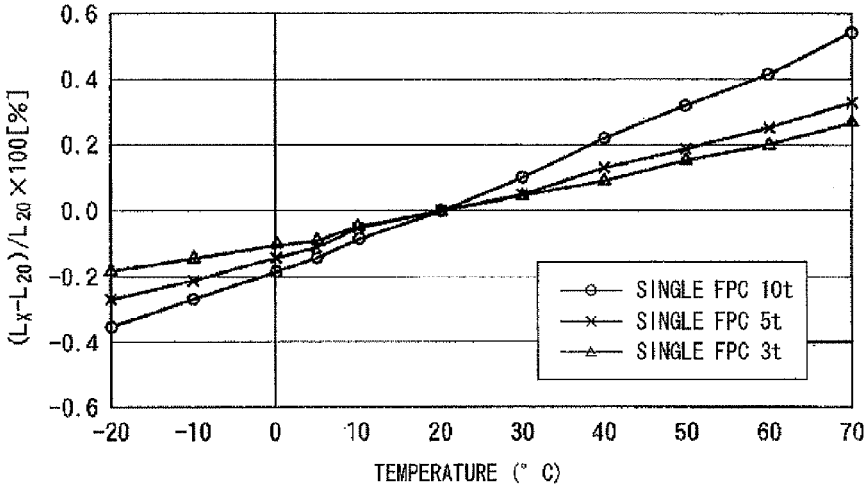
FIG. 5
FIG. 6A
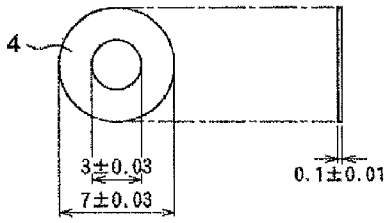
FIG. 6B
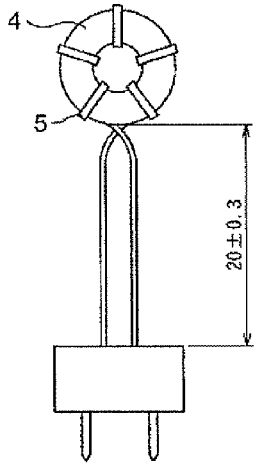

ANTENNA DEVICE AND COMMUNICATION DEVICE

FIELD OF THE INVENTION

This invention relates to an antenna device performing information communications by electromagnetic field coupling between paired electrodes facing each other and a communication device having this antenna device incorporated therein.

The present application asserts priority rights based on JP Patent Application 2010-268395 filed in Japan on Dec. 1, 2010. The total contents of disclosure of the patent application of the senior filing date are to be incorporated by reference into the present application.

BACKGROUND OF THE INVENTION

In recent years, noncontact communication technology for interchanging signals by electromagnetic induction has been established and increasingly used for transportation tickets and electronic money. Also, this noncontact communication function tends to be mounted also on a portable phone, and this trend is expected to be developed more in the future. Not only in proximity communication by electromagnetic induction but also in logistics, an IC tag readable or writable at a distance of several meters has also been commercialized. Furthermore, this noncontact communication technology allows not only noncontact communications but also power transmission at the same time, and therefore can also be implemented on an IC card without a power supply such as a battery in itself.

As antenna modules for RFID (Radio Frequency Identification) to which this noncontact communication technology is applied, several types have been conventionally used as follows. Firstly, there is an antenna module having a coil pattern fabricated on a flat surface by using a FPC (Flexible Printed Circuit) or a rigid substrate. Secondly, there is an antenna module having a coil fabricated by winding a circular cross-sectional wire. Thirdly, there is an antenna module having a coil formed by taking a FPC, a FFC (Flexible Flat Cable), or the like as a harness and shaping that harness into a ring.

Any of the antenna modules described above is selected as appropriate according to the design in consideration of the arrangement and shapes of components, and is incorporated in an electronic device for use.

When an antenna module is arranged in an electronic device, due to an influence of a metal used in a metal-made casing or an internal component of the electronic device, magnetic flux oscillated from a reader/writer cannot be efficiently drawn to the antenna coil. To avoid such suffering from this metal influence, a ferrite-made magnetic sheet with a relatively high-permeability and a small loss factor is mounted on the perimeter of the antenna in the antenna module.

For example, FIG. 12 depicts, sequentially from left, an inductance of a single antenna coil, an inductance of an antenna coil in proximity to a metal body, and an inductance of an antenna coil when a magnetic sheet is arranged between the antenna coil and the metal body.

As such, with a ferrite-made magnetic sheet having an excellent magnetic characteristic being arranged so as to be superposed on the antenna module, a magnetic field is prevented from entering the metal arranged around the antenna module to become an eddy current to be changed into heat. Also, the ferrite-made magnetic sheet has its shape, combination, and others optimized so as to obtain excellent communication performance. Furthermore, to make a portable electronic device such as a portable phone thinner, the antenna module is desired to be made as thin as possible, as being laminated with the ferrite-made magnetic sheet.

Still further, in a communication system to which this noncontact communication is applied, a resonant capacitor is connected to a loop antenna for performing noncontact communications and power transmission between a reader/writer and a noncontact data carrier, and a resonance frequency represented by $f=1/(2\pi(LC)^{1/2})$ is matched with a normal frequency of the system, thereby allowing stable communications between the reader/writer and the noncontact data carrier and maximizing a communication distance. L and C determined by the characteristics of the loop antenna and the resonant capacitor have several variable factors, and each do not necessarily have an assumed value. For example, in a communication system with a normal frequency of 13.56 [MHz] and for the use purpose of transportation tickets and electronic money, in view of reliability, the resonance frequency of a resonant circuit of an antenna module is required to be suppressed to be on the order of 13.56 [MHz]±200 [KHz] even if the system receives an influence of the variable factors described above.

Here, in the noncontact data carrier, the loop antenna is formed of a copper foil pattern to decrease cost, and the value of L is varied due to a deviation of the pattern width or the like. Regarding a temperature change rate of each of C determined by the characteristics of a general chip capacitor and L determined by the characteristics of the antenna coil, a variation of L with respect to C may be on the order of 100-fold in level. For example, if the value of L is 2.5 [μH] and 1% is displaced, the resonance frequency is shifted by 70 KHz, and therefore minimal fluctuations with respect to the temperature of the L value are desired.

Patent Document 1 describes a communication device in order to prevent the resonance frequency from fluctuating due to temperature changes as described above, the communication device including a temperature detecting unit and a frequency shift that shifts the resonance frequency to be tuned at a tuning unit according to a temperature detected from that temperature detection.

PRIOR-ART DOCUMENT

Patent Document

PTL 1: Japanese Patent Application Laid-Open No. 2007-104092

SUMMARY OF THE INVENTION

Also, the temperature characteristic of the inductance of the antenna coil is changed also depending on the composition of the magnetic sheet arranged at a position in proximity to the substrate where the antenna coil is fabricated. Here, FIG. 13 depicts temperature characteristics of an inductance of an antenna module having a magnetic sheet made of a magnetic material KM11 and KM21 with different compositions laminated on a printed board where an antenna coil is fabricated. In this FIG. 13, the horizontal axis represents temperature and the vertical axis represents values of a difference ratio (Lx−L20)×100/L20 of an inductance Lx with temperature changes with respect to an inductance L20 at 20° C. set as an example of a design center.

As can be seen in FIG. 13, for the inductance L20 at 20° C. as the design center, a shift occurs in each magnetic sheet approximately by 1.0% to 2.0% at maximum in a temperature range of −20° C. to 60° C., disadvantageously resulting in a large shift in resonance frequency.

For these temperature characteristics, the communication device described in Patent Document 1 described above takes circuit-like measures for a frequency correction process, and therefore incorporation in an electronic device such as a portable phone requiring a small space is difficult.

The present invention is suggested in view of these circumstances, and has an object of providing an antenna device capable of stable communications by keeping a resonance frequency substantially constant even if the temperature changes without increasing a space of the entire device, and a communication device having this antenna device incorporated therein.

As means for solving the problems described above, an antenna device according to the present invention includes a resonant circuit having an antenna coil and a capacitor electrically connected to the antenna coil, the antenna coil receiving a magnetic field transmitted from a transmitter at a predetermined oscillation frequency, the resonant circuit becoming communicable when inductively coupled to the transmitter; and a magnetic sheet to be formed at a position superposed on the antenna coil to change an inductance of the antenna coil, wherein the antenna coil has a temperature characteristic in which the inductance is changed with a temperature change, and the magnetic sheet is made of a magnetic material having a temperature characteristic of changing the inductance of the antenna coil so as to achieve a characteristic inverse to the change of the inductance of the antenna coil with the temperature change in a predetermined use temperature range and substantially matching a resonance frequency of the resonant circuit with the oscillation frequency in the use temperature region.

Also, a communication device according to the present invention includes a resonant circuit having an antenna coil and a capacitor electrically connected to the antenna coil, the antenna coil receiving a magnetic field transmitted from a transmitter at a predetermined oscillation frequency, the resonant circuit becoming communicable when inductively coupled to the transmitter; a magnetic sheet to be formed at a position superposed on the antenna coil to change an inductance of the antenna coil; and a communication processing unit to be driven by a current flowing through the resonant circuit to perform communications, wherein the antenna coil has a temperature characteristic in which the inductance is changed with a temperature change, and the magnetic sheet is made of a magnetic material having a temperature characteristic of changing the inductance of the antenna coil so as to achieve a characteristic inverse to the change of the inductance of the antenna coil with the temperature change in a predetermined use temperature range and substantially matching a resonance frequency of the resonant circuit with the oscillation frequency in the use temperature region.

In the present invention, the magnetic sheet is formed so as to be superposed on the antenna coil, the magnetic sheet having the temperature characteristic of changing the inductance of the antenna coil so as to achieve the characteristic inverse to the change of the inductance of the antenna coil with the temperature change in the use temperature range and substantially matching the resonance frequency of the resonant circuit with the oscillation frequency in the use temperature region. As such, in the present invention, the change of the resonance frequency due to the change of the inductance of the antenna coil with the temperature change is cancelled out by the change of the inductance of the antenna coil with the temperature characteristic of the magnetic sheet. Thus, in the present invention, since a frequency correction process is not performed with circuit-like measures, the space of the entire device is not increased, the resonance frequency is kept substantially constant even if the temperature changes in the preset use temperature range, and stable communications can be performed.

BRIEF DESCRIPTION OF DRAWINGS

FIG. 5 is a diagram when the horizontal axis represents temperature and the vertical axis represents values of a difference ratio (Lx−L20)×100/L20 of an inductance Lx with temperature changes with respect to an inductance L20 at 20° C., which is a designed center.

FIG. 6A and FIG. 6B are diagrams for describing measurement of magnetic characteristics of the magnetic sheet using a ring processed to have a troidal ring shape.

DETAILED DESCRIPTION OF THE INVENTION

An embodiment for carrying out the present invention is described in detail below with reference to the drawings. Note that the present invention is not restricted only to the embodiment below and, needless to say, can be variously changed within a range not deviating from the gist of the present invention.

<Entire Structure>

Figure 1:
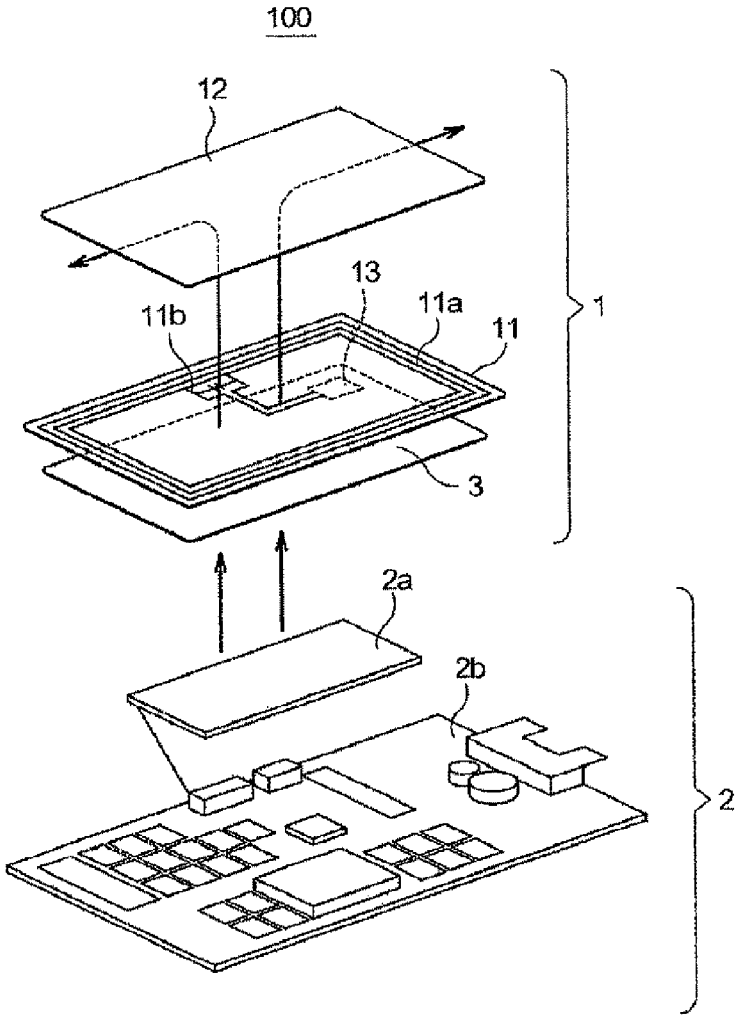
FIG. 1 is a diagram of an entire structure of a wireless communication system.

An antenna module to which the present invention is applied is an antenna device that becomes in a communicable state by electromagnetic induction occurring between the antenna module and a transmitter transmitting electromagnetic waves, and is used as being incorporated in a wireless communication system 100 for RFID (Radio Frequency Identification) as depicted in FIG. 1, for example.

The wireless communication system 100 includes an antenna module 1 to which the present invention is applied and a reader/writer 2 accessing the antenna module 1.

The reader/writer 2 functions as a transmitter transmitting a magnetic field to the antenna module 1 and, specifically, includes an antenna 2*a* transmitting a magnetic field toward the antenna module 1 and a control substrate 2*b* communicating with the antenna module 1 inductively coupled via the antenna 2*a*.

That is, the reader/writer 2 has the control substrate 2*b* provided thereon, the control substrate 2*b* electrically connected to the antenna 2*a*. On this control substrate 2*b*, a control circuit formed of one or a plurality of electronic components such as integrated circuit chips are mounted. This control circuit executes various processes based on data received from the antenna module 1. For example, when writing data in the antenna module 1, the control circuit encodes the data, modulates a carrier wave of a predetermined frequency (for example, 13.56 MHz) based on the encoded data, amplifies the modulated modulation signal, and drives the antenna 2*a* with the amplified modulation signal. Also, when reading data from the antenna module 1, the control circuit amplifies a modulation signal of data received at the antenna 2*a*, demodulates the amplified modulation signal of the data, and decodes the demodulated data. Note that encoding and modulating schemes for use in a general reader/writer are used in the control circuit and, for example, a Manchester encoding scheme or an ASK (Amplitude Shift Keying) modulating scheme are used.

The antenna module 1 to be incorporated inside a casing 3 of the electronic device includes an antenna circuit 11 where an antenna coil 11*a* capable of communications with the inductively-coupled reader/writer 2 is mounted, a magnetic sheet 12 formed at a position superposed on the antenna coil 11*a* to draw a magnetic field to the antenna coil 11*a*, and a communication processing unit 13 to be driven by a current flowing through the antenna circuit 11 to communicate with the reader/writer 2.

The antenna circuit 11 is a circuit corresponding to a resonant circuit according to the present invention, and includes the antenna coil 11*a* and a capacitor 11*b* electrically connected to the antenna coil 11*a*.

When receiving a magnetic field transmitted from the reader/writer 2 at the antenna coil 11*a*, the antenna circuit 11 is magnetically coupled to the reader/writer 2 by inductive coupling, receives a modulated electromagnetic wave, and supplies a reception signal to the communication processing unit 13.

The magnetic sheet 12 is formed at a position superposed on the antenna coil 11*a* in order to draw the magnetic field transmitted from the reader/writer 2 to the antenna coil 11*a*, and changes the inductance of the antenna coil 11*a* so that the inductance is increased compared with the case in which the magnetic sheet 12 is not present. Specifically, to inhibit a metal component provided inside the casing 3 of the portable electronic device from reflecting the magnetic field transmitted from the reader/writer 2 and to inhibit the occurrence of an eddy current, the magnetic sheet 12 is configured to be laminated on a side opposite to a direction in which the magnetic field is irradiated to come.

The communication processing unit 13 is driven by a current flowing through the electrically-connected antenna circuit 11, and performs communications with the reader/writer 2. Specifically, the communication processing unit 13 demodulates a received modulation signal, decodes the demodulated signal, and writes the decoded data into a memory 133, which will be described further below. Also, the communication processing unit 13 reads data to be transmitted to the reader/writer 2 from the memory 133, encodes the read data, modulates a carrier wave based on the encoded data, and transmits to the reader/writer 2 an electric wave modulated via the antenna circuit 11 magnetically coupled by induction coupling.

Figure 2:
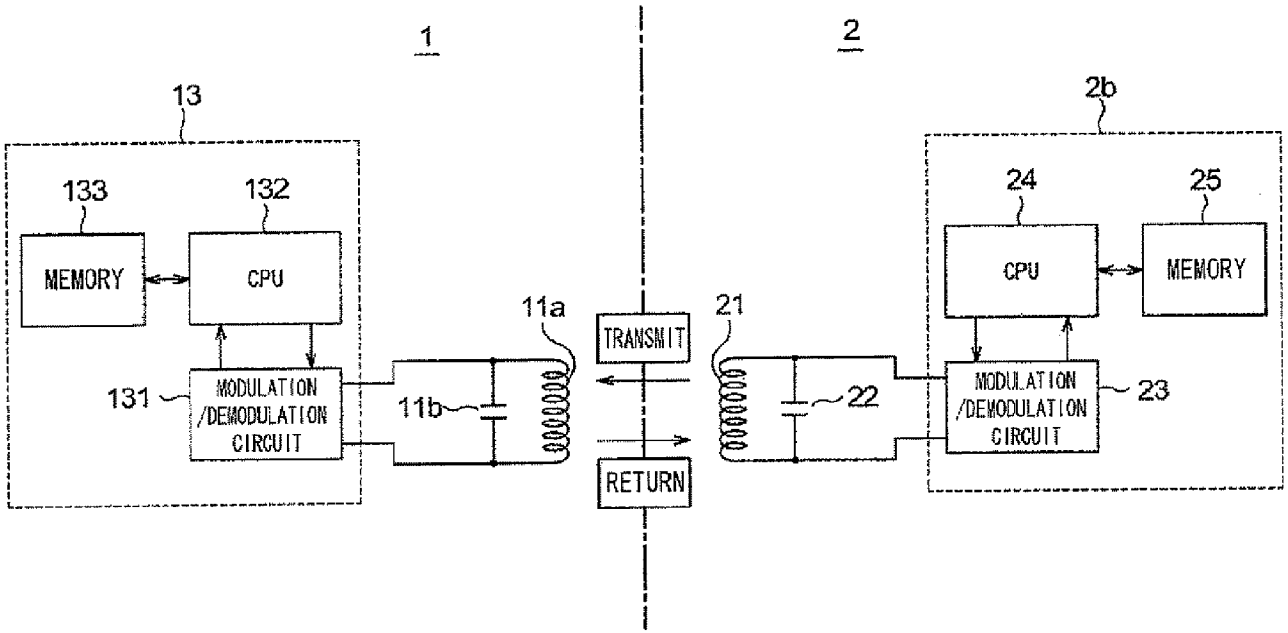
FIG. 2 is a diagram of a circuit structure according to the wireless communication system.

In the wireless communication system 100 configured as descried above, a specific circuit structure of the antenna circuit 11 of the antenna module 1 is described with reference to FIG. 2.

As described above, the antenna circuit 11 includes the antenna coil 11*a* and the capacitor 11*b*.

The antenna coil 11*a* is formed in a rectangular shape, for example, and generates a counter electromotive force in accordance with a change of a magnetic flux interlinking to the antenna coil 11*a* among magnetic fluxes irradiated from the antenna 2*a* of the reader/writer 2. The capacitor 11*b* is connected to the antenna coil 11*a* to configure a resonant circuit.

As such, in the antenna circuit 11, the antenna coil 11*a* and the capacitor 11*b* are electrically connected to configure a resonant circuit and, with an inductance L of the antenna coil 11*a* and a capacitance C of the capacitor 11*b*, a resonance frequency represented by $f=1/(2\pi(LC)^{1/2})$ is set.

The communication processing unit 13 is configured of a microcomputer including a modulation/demodulation circuit 131, a CPU 132, and the memory 133.

The modulation/demodulation circuit 131 performs a modulation process of generating a modulated wave with data to be transmitted from the antenna circuit 11 to the reader/writer 2 superposed on a carrier. The modulation/demodulation circuit 131 also performs a demodulation process of extracting data from a modulated wave outputted from the reader/writer 2.

The CPU 132 performs processes of controlling the modulation/demodulation circuit 131 so that the data read from the memory 133 is sent to the reader/writer 2 and also writing data demodulated by the modulation/demodulation circuit 131 in the memory 133.

In the reader/writer 2 performing communications with the antenna module 1 having the structure described above, the antenna 2*a* includes an antenna coil 21 and a capacitor 22, and the control substrate 2*b* includes a modulation/demodulation circuit 23, a CPU 24, and a memory 25.

The antenna coil 21 is formed in a rectangular shape, for example, and is magnetically coupled to the antenna coil 11*a* on the antenna module 1 side, thereby transmitting and receiving various data such as a command and write data and further supplying power for use in the antenna module 1.

The capacitor 22 is connected to the antenna coil 21 to configure a resonant circuit. The modulation/demodulation circuit 23 performs a modulation process for generating a modulated wave with data to be transmitted from the reader/writer 2 to the antenna module 1 superposed on a carrier. The modulation/demodulation circuit 23 also performs a demodulation process of extracting data from a modulated wave sent from the antenna module 1.

The CPU 24 performs processes of controlling the modulation/demodulation circuit 23 so that the data read from the memory 25 is sent to the antenna module 1 and also writing data demodulated by the modulation/demodulation circuit 23 in the memory 25.

In the antenna circuit 11 of the antenna module 1, in view of achieving stable communications, the inductance L of the antenna coil 11*a* and the capacitance C of the capacitor 11*b* are adjusted so that the resonance frequency of the antenna circuit 11 matches an oscillation frequency of the reader/writer 2.

<Temperature Compensation>

In the antenna module 1 configured as described above, in view of preventing a shift of the resonance frequency of the antenna circuit 11 with a temperature change in a use temperature range, the size of the coil is changed with expansion and contraction of a conductive material with the temperature change, thereby changing the inductance L of the antenna coil 11*a*. By focusing attention on this characteristic, the magnetic sheet 12 has the following characteristics.

That is, the magnetic sheet 12 is made of a magnetic material having a temperature characteristic of changing the inductance of the antenna coil 11*a* so as to achieve a characteristic inverse to a change of the inductance of the antenna coil 11*a* with a temperature change in the use temperature range and substantially matching the resonance frequency of the antenna circuit 11 with the oscillation frequency of the reader/writer 2 in the use temperature range.

As a specific example, it is assumed in the present embodiment that the antenna coil 11*a* has a characteristic that its number of windings is 3 to 10 and the change of the inductance at 13.56 MHz, which is the resonance frequency of the antenna circuit 11, is monotonously increased. In contrast with this temperature characteristic of the antenna coil 11*a*, it is assumed that the magnetic sheet 12 has a characteristic that the inductance of the antenna coil 11*a* is monotonously decreased with a temperature change at 20° C.±5° C. or higher. And, with the magnetic sheet 12 being arranged in proximity to the antenna coil 11*a* described above so that the coupling distance is 10 μm to 255 μm, a monotonous increase of the inductance of the antenna coil 11*a* with a temperature change is cancelled out by a change of the inductance of the antenna coil 11*a* with the temperature characteristic of the magnetic sheet 12.

Figure 3:
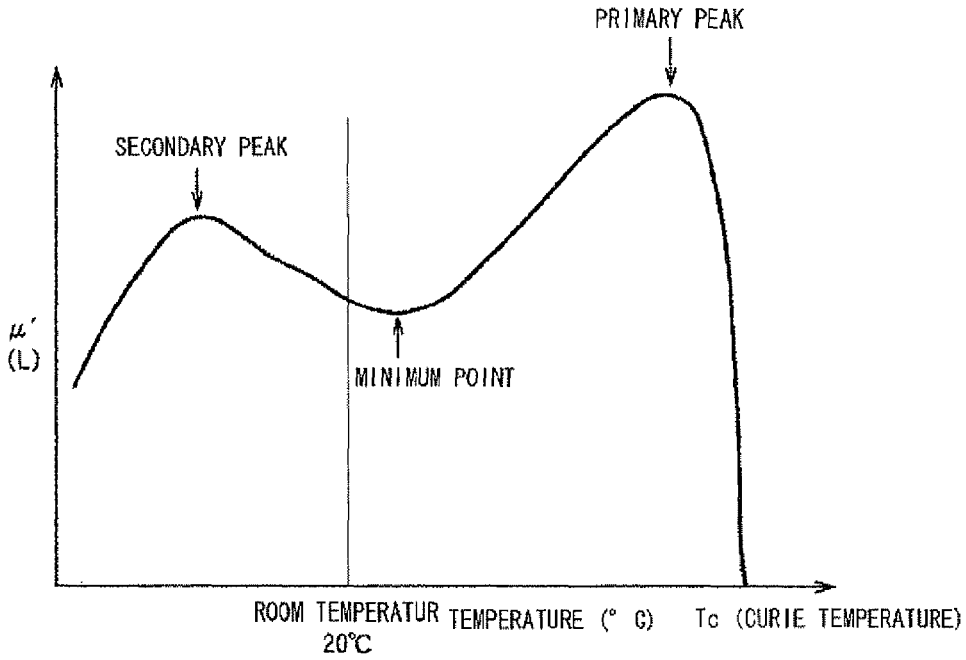
FIG. 3 is a diagram for describing a temperature characteristic of a ferrite-made magnetic sheet.

The magnetic sheet 12 can be made of any magnetic material as long as the material achieves temperature compensation as described above. When a ferrite with relatively high μ' is used as a magnetic material, the magnetic sheet 12 has a temperature characteristic of changing the inductance of the antenna coil 11*a* so that two peaks appear with a temperature change, as depicted in FIG. 3.

For example, when the use temperature range is set as −20° C. to 60° C., a peak value appearing second (hereinafter referred to as a secondary peak) has a temperature of −20° C. to 20° C. and the magnetic sheet 12 cancels out the characteristic of a monotonous increase of the inductance of the antenna coil 11*a* with a temperature change in a range with a temperature higher than that of the secondary peak. For this purpose, a material having the following composition is preferably used.

That is, the magnetic sheet 12 is a ferrite with a Sb oxide and a Co oxide contained in a Ni—Zn—Cu-based magnetic material, and satisfies conditions as follows. Here, the magnetic sheet 12 contains 0.7 weight % to 1.25 weight % of a Sb oxide in $Sb_2O_3$ terms and 0 to 0.2 weight % of a Co oxide in CoO terms.

As such, in the antenna module 1, a change of the resonance frequency due to a change of the inductance of the antenna coil 11*a* with a temperature change is cancelled out by a change of the inductance of the antenna coil 11*a* with the temperature characteristic of the magnetic sheet 12. Thus, since the antenna module 1 does not take circuit-like measures for a frequency correction process, the space of the entire device is not increased, the resonance frequency is kept substantially constant even if the temperature changes in the preset use temperature range, and stable communications can be performed.

Example 1

Figure 4A:
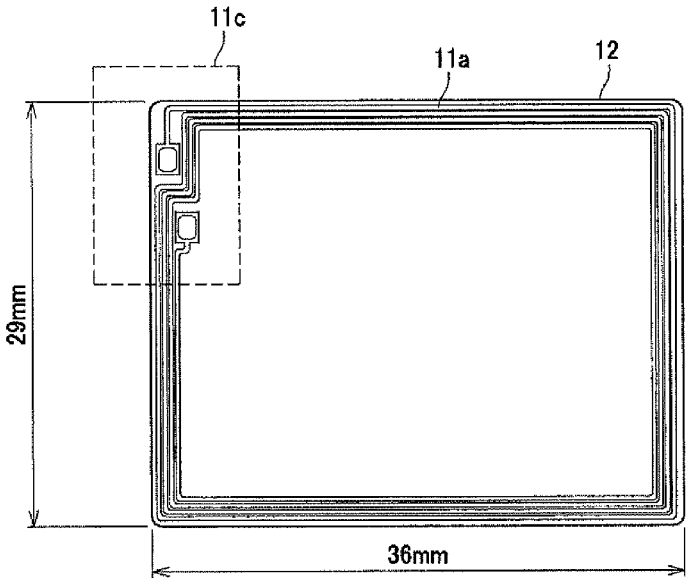
FIG. 4A and FIG. 4B are diagrams for describing an outer shape of an antenna module 1 according to an example.
Figure 4B:
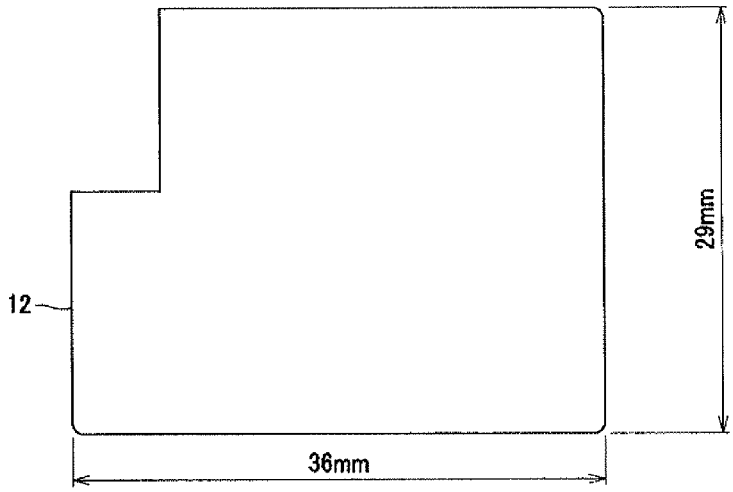

As a specific example of an antenna module to be incorporated in a portable phone or the like, an antenna module as follows was used. That is, as the antenna coil 11*a*, one fabricated by a patterning process on a flexible printed board 11*c* having an outer shape of 36 [mm]×29 [mm] and a thickness of 0.09 [mm] as depicted in FIG. 4A was used. Also, as the magnetic sheet 12, a ferrite having an outer shape of 36 [mm]×29 [mm] and μ'=119 and μ"=1.33 with a frequency of 13.56 MHz as depicted in FIG. 4B was used. Also, the flexible printed board 11*c* where the antenna coil 11*a* is fabricated and the magnetic sheet 12 are assumed to be coupled via an acrylic-based ADH sheet having a thickness of 0.3 mm as an adhesive.

First, FIG. 5 depicts the results of measurement of the temperature characteristic of the inductance of each antenna coil 11*a* in the case of the single flexible printed board 11*c* without having the magnetic sheet 12 coupled thereto, the number of windings being 3, 5, and 10, and Cu being used as a conductor wire. This FIG. 5 depicts that the vertical axis represents temperature and the horizontal axis represents values of a difference ratio (Lx−L20)×100/L20 of an inductance Lx with temperature changes with respect to an inductance L20 at 20° C., which is a designed center. Note that legends in FIG. 5 of "3t", "5t", and "10t" represent that the number of windings of the antenna coil 11*a* is 3, 5, and 10, respectively.

As depicted in FIG. 5, the inductances of all three types of antenna coils 11*a* are monotonously increased with temperature changes. In particular, among all three types of antenna coils 11*a*, a change of the inductance of the antenna module having a large number of windings with respect to temperature is relatively large. This is because Cu, which is a conductor wire of the antenna coil 11*a*, has a relatively large coefficient of linear expansion a of 16.5 and the inductance L represented by $L=AN^2S$ is changed with a change of an area S of the antenna coil 11*a* with a change of a pattern length with respect to temperature. Here, A represents a factor of proportionality and N represents the number of windings.

Next, since an inductance of the magnetic sheet 12 cannot be measured as a single, it is assumed that, for example, a ring 4 is fabricated by processing the magnetic material of the magnetic sheet 12 into a toroidal ring shape having an inner diameter of 3 mm±0.03 mm, an outer diameter of 7 mm±0.03 mm, and a thickness of 0.1 mm±0.01 as depicted in FIG. 6A, a conductor wire 5 is wound around this ring 4 as depicted in FIG. 6B, and then an inductance is measured when a signal of 13.56 MHz is let flow through the conductor wire. The inductance measured in this manner can be evaluated as a characteristic value of the magnetic material.

Figure 7:
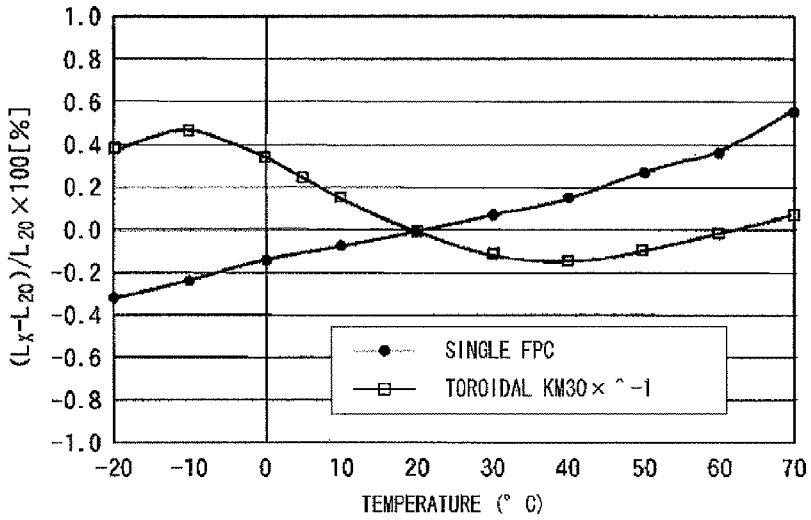
FIG. 7 is a diagram for describing magnetic characteristics of a ferrite containing an Sb oxide and a Co oxide in a Ni—Zi—Cu-based magnetic material.

For temperature compensation of the inductance of the antenna coil 11*a* by utilizing measurement using this troidal ring, as a specific example of the ferrite with the Sb oxide and the Co oxide contained in the Ni—Zn—Cu-based magnetic material, it is assumed that a magnetic material having a temperature characteristic as depicted in FIG. 7 is used. In the magnetic sheet according to this example, the ferrite containing 1.2 weight % of the Sb oxide in $Sb_2O_3$ terms and 0.2% of the Co oxide in CoO terms was used. This is an example satisfying the condition that the magnetic material contains 0.7 weight % to 1.25 weight % of the Sb oxide in $Sb_2O_3$ terms and 0 to 0.2 weight % of the Co oxide in CoO terms. That is, it is assumed to use a magnetic material KM30 having a temperature characteristic as depicted in FIG. 7 in which a secondary peak is present near −10° C. and the inductance is monotonously decreased with temperature changes higher than the secondary peak. Here, FIG. 7 depicts the temperature characteristic of the inductance of the antenna coil 11*a* with the single flexible printed board 11*c* described above and the number of windings being 10, and depicts a temperature characteristic of the inductance of the magnetic material KM30 measured by the troidal ring, with 1/10 of a scaling factor of the vertical axis with respect to this temperature characteristic.

Figure 8:
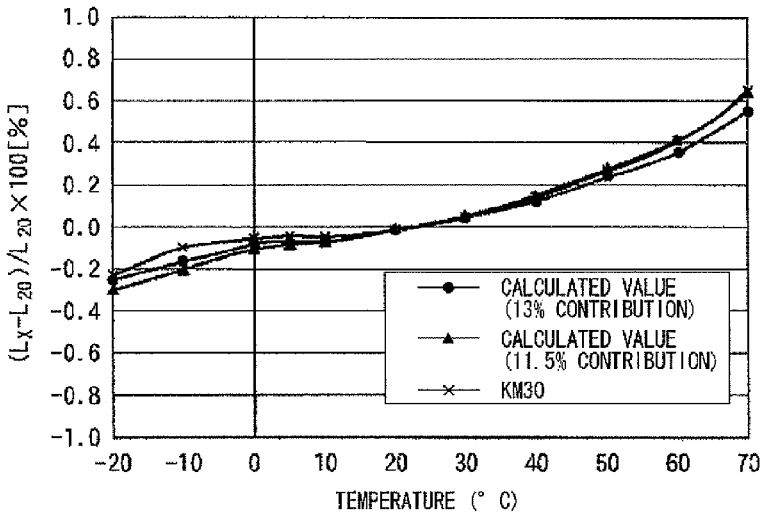
FIG. 8 is a diagram for describing a temperature characteristic of an inductance of an antenna coil according to an embodiment.

In the antenna module 1 according to the present example, with the magnetic sheet 12 made of this magnetic material KM30 being coupled via the ADH sheet having a thickness of 0.3 mm to the flexible printed board 11*c* where the antenna coil 11*a* having the number of windings of 10 described above is fabricated, the inductance of the antenna coil 11*a* can be kept constant in a temperature region of at least −10° C. to 40° C., as depicted in FIG. 8.

In FIG. 8, as an actually measured value (KM30) and a calculated value substantially matching the actually measured value (KM30), the following two calculated values are depicted. That is, these calculated values are those obtained by adding weights of 13% and 11.5% each as a contribution ratio with respect to the actually measured values of the FPC (single) to the calculated values, which are characteristic values using the troidal ring depicted in FIG. 7. As evident from this FIG. 8, the magnetic sheet 12 influences the temperature characteristic of the inductance of the antenna coil 11*a* by approximately 11.5% to 13%. As evident from these results, by using the characteristic values obtained by using the troidal ring, it is possible to easily achieve a design in which the degree of temperature compensation with respect to the inductance of the antenna coil 11*a* is evaluated and the temperature characteristics of the inductances substantially match each other.

Note that the secondary peak is on the order of −20° C. and the magnetic sheet 12 made of a ferrite having a temperature characteristic that the inductance is monotonously decreased to the proximity of 60° C. at a temperature equal to or higher than this secondary peak can be achieved by causing the Ni—Zn—Cu-based magnetic material described above to contain a Sb oxide and a Co oxide under the predetermined condition. Therefore, in the temperature range of −20° C. to 60° C., the inductance of the antenna coil 11*a* can be kept constant.

Figure 9:
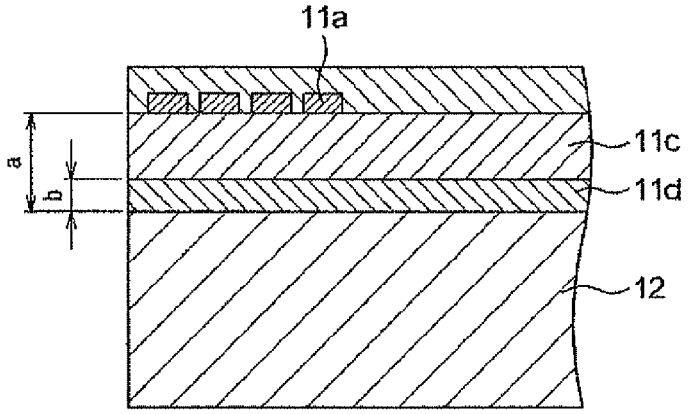
FIG. 9 is a diagram for describing a sectional shape of the antenna module according to an example.

Here, as depicted in FIG. 9, changes of the inductance when the coupling distance between the magnetic sheet 12 and the antenna coil 11*a* is changed by changing the thickness of the ADH sheet 11*d* are described. This FIG. 9 is a diagram depicting a sectional shape of the antenna module 1, with a total value of the thickness of the flexible printed board 11*c* and the thickness of the ADH sheet 11*d* being taken as a and the thickness of the ADH sheet 11*d* being taken as b.

Figure 10:
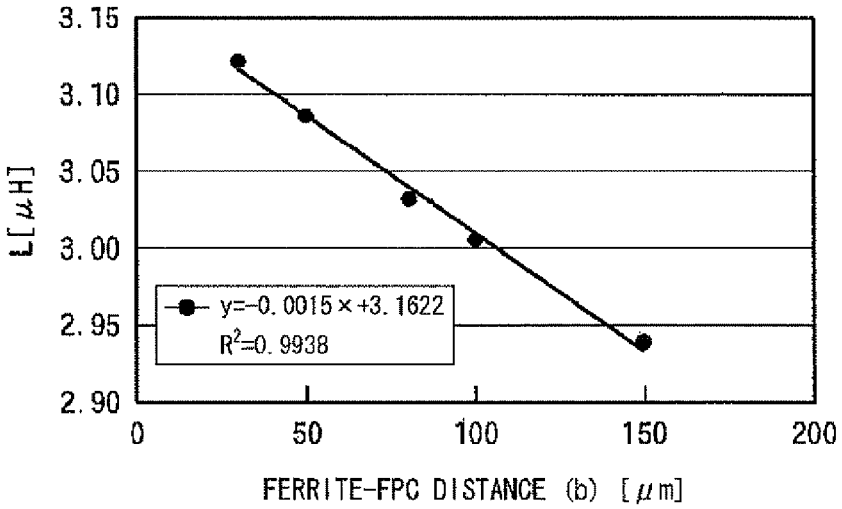
FIG. 10 is a diagram depicting changes of the inductance when the thickness of an ADH sheet is changed.

FIG. 10 is a diagram depicting changes of the inductance when the thickness b of the ADH sheet 11*d* is changed. As evident from this FIG. 10, when the coupling distance between the magnetic sheet 12 and the antenna coil 11*a* is increased, the inductance is monotonously decreased and, contrarily, when this coupling distance is decreased, the inductance is increased because the magnetic flux generated from the antenna coil 11*a* is strongly influenced by the magnetic sheet 12. Specifically, when the thickness b is taken as a variable x, an approximation function y of the inductance is represented as $y=-0.0015x+3.1622$ Here, a square $R^2$ of a similarity index R is 0.9938.

Figure 11A:
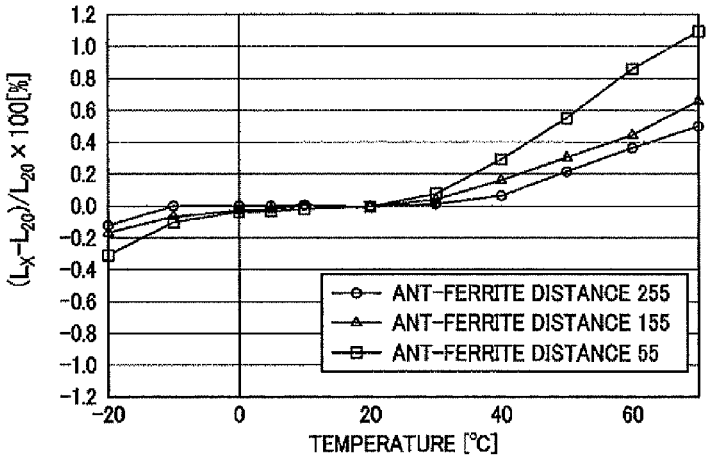
FIG. 11A to FIG. 11C are diagrams for describing a temperature characteristic of the inductance of the antenna coil according to changes of a total value of thicknesses of a flexible printed board and the ADH sheet.

Also, in the temperature range of at least −10° C. to 40° C., with the magnetic sheet 12 and the flexible printed board being coupled to each other to keep the inductance of the antenna coil 11*a* constant, the temperature characteristics of the inductance of the antenna coil 11*a* are depicted in FIG. 11A where a total value of thicknesses of the flexible printed board 11*c* and the ADH sheet 11*d* is set as 255 μm, 155 μm, and 55 μm.

As evident from this FIG. 11A, as a clearance distance between the magnetic sheet 12 and the antenna coil 11*a* is shorter, the temperature change characteristic of the inductance tends to be intensified.

As such, in the antenna module 1, by adjusting the clearance distance between the magnetic sheet 12 and the antenna coil 11*a*, a change of the inductance with a temperature characteristic allowed with upper and lower limit values of the use temperature range can be adjusted.

Figure 13:
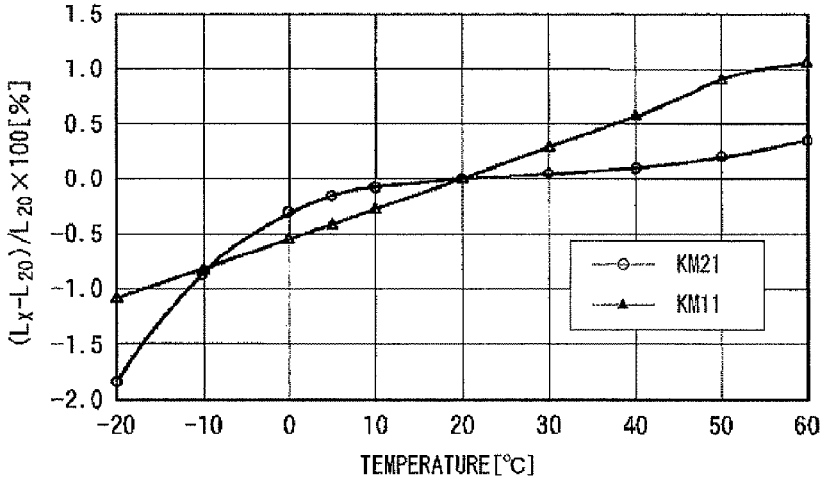
FIG. 13 is a diagram when the horizontal axis represents temperature and the vertical axis represents values of a difference ratio (Lx−L20)×100/L20 of an inductance Lx with temperature changes with respect to an inductance L20 at 20° C. set as an example of a design center.

Also, under the condition that the total value a of the thicknesses described above is set as 255 μm, FIG. 11B depicts a temperature change characteristic of the inductance when the magnetic sheet 12 made of a magnetic material KM30 is used according to the present example and a temperature change characteristic of the inductance when a magnetic sheet made of a magnetic material KM11 as depicted in FIG. 13 is used as a comparative example.

Still further, under the condition that the total value a of the thicknesses described above is set as 55 μm, FIG. 11C depicts a temperature change characteristic of the inductance when the magnetic sheet 12 made of the magnetic material KM30 is used according to the present example and a temperature change characteristic of the inductance when the magnetic sheet made of the magnetic material KM11 as depicted in FIG. 13 is used as the comparative example.

Figure 11B:
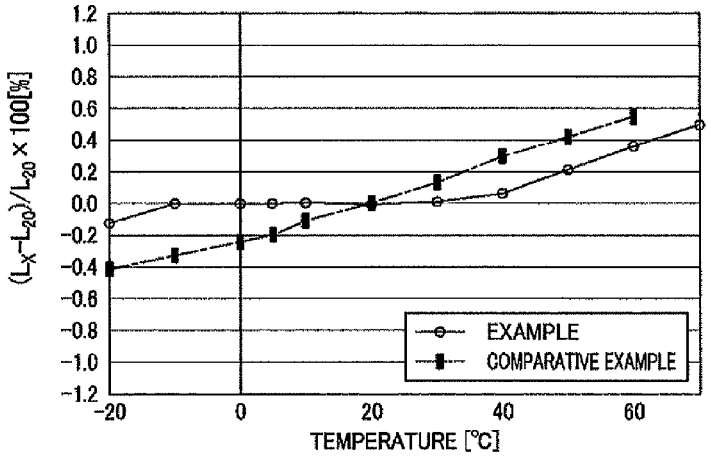
Figure 11C:
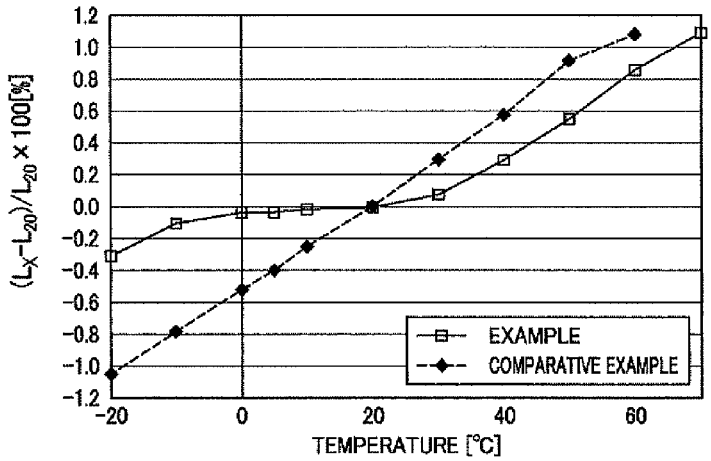
Figure 12:
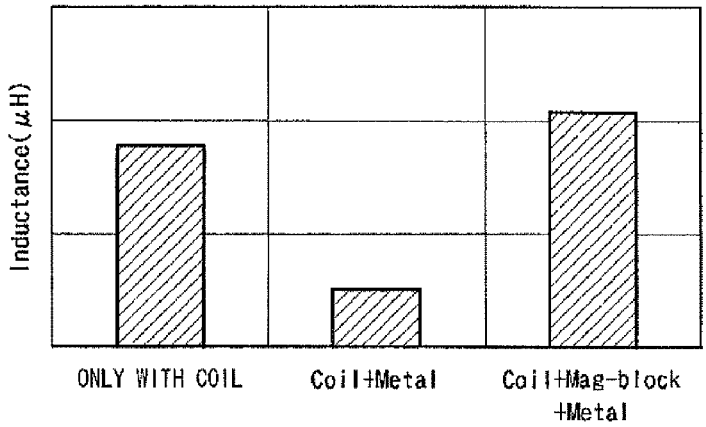
FIG. 12 is a diagram for describing a function of a magnetic sheet arranged adjacently to the antenna coil.

As evident from these FIG. 11B and FIG. 11C, for example, compared with the conventional example using the magnetic sheet made of the magnetic material KM11, the antenna module 1 according to the present example can suppress the temperature change characteristic of the inductance that tends to be increased due to a decrease of the clearance distance between the magnetic sheet 12 and the antenna coil 11*a*.

The invention claimed is:

1. An antenna device comprising:

a resonant circuit having an antenna coil and a capacitor electrically connected to the antenna coil, the antenna coil receiving a magnetic field transmitted from a transmitter at a predetermined oscillation frequency, the resonant circuit becoming communicable when inductively coupled to the transmitter; and a magnetic sheet to be formed at a position superposed on the antenna coil to change an inductance of the antenna coil, the antenna coil having a temperature characteristic in which the inductance is monotonously changed with a temperature change in a use temperature range, and the magnetic sheet being made of a magnetic material having a temperature characteristic of monotonously decreasing the inductance of the antenna coil so as to achieve a characteristic inverse to the change of the inductance of the antenna coil with the temperature change in the use temperature range and substantially matching a resonance frequency of the resonant circuit with the oscillation frequency in the use temperature range.

2. The antenna device according to claim 1, wherein the magnetic sheet is a ferrite with a Sb oxide and a Co oxide contained in a Ni—Zn—Cu-based magnetic material.

3. The antenna device according to claim 2, wherein the magnetic sheet is made of the ferrite containing 0.7 weight % to 1.25 weight % of the Sb oxide in $Sb_2O_3$ terms and 0 to 0.2 weight % of the Co oxide in CoO terms.

4. A communication device comprising:

an antenna device comprising:

a resonant circuit having an antenna coil and a capacitor electrically connected to the antenna coil, the antenna coil receiving a magnetic field transmitted from a transmitter at a predetermined oscillation frequency, the resonant circuit becoming communicable when inductively coupled to the transmitter; and a magnetic sheet to be formed at a position superposed on the antenna coil to change an inductance of the antenna coil; and a communication processing unit to be driven by a current flowing through the resonant circuit to perform communications, the antenna coil having a temperature characteristic in which the inductance is monotonously changed with a temperature change in a use temperature range, and the magnetic sheet being made of a magnetic material having a temperature characteristic of monotonously decreasing the inductance of the antenna coil so as to achieve a characteristic inverse to the change of the inductance of the antenna coil with the temperature change in the use temperature range and substantially matching a resonance frequency of the resonant circuit with the oscillation frequency in the use temperature range.

* * * * *